US010583548B2

(12) United States Patent
Sun

(10) Patent No.: US 10,583,548 B2
(45) Date of Patent: Mar. 10, 2020

(54) SILENCING MECHANISM OF PNEUMATIC TOOL

(71) Applicant: STORM PNEUMATIC TOOL CO., LTD., Taichung (TW)

(72) Inventor: Yung Yung Sun, Taichung (TW)

(73) Assignee: STORM PNEUMATIC TOOL CO., LTD., Taichung (TW)

( * ) Notice: Subject to any disclaimer, the term of this patent is extended or adjusted under 35 U.S.C. 154(b) by 336 days.

(21) Appl. No.: 15/684,362

(22) Filed: Aug. 23, 2017

(65) Prior Publication Data

US 2019/0061134 A1 Feb. 28, 2019

(51) Int. Cl.

| | |
|---|---|
| ***B25F 5/00*** | (2006.01) |
| ***G10K 11/00*** | (2006.01) |
| ***B25C 1/04*** | (2006.01) |
| ***G10K 11/16*** | (2006.01) |

(52) U.S. Cl.

CPC ..... *B25F 5/00* (2013.01); *B25C 1/047* (2013.01); *G10K 11/002* (2013.01); *G10K 11/161* (2013.01)

(58) Field of Classification Search

CPC ..... G10K 11/002; B25F 5/00
USPC ..... 181/230, 223
See application file for complete search history.

(56) References Cited

U.S. PATENT DOCUMENTS

| | | | | |
|---|---|---|---|---|
| 4,576,083 | A * | 3/1986 | Seberger, Jr. | F01N 1/08 181/223 |
| 5,767,459 | A * | 6/1998 | Sell | F01N 1/082 181/230 |
| 6,209,678 | B1 * | 4/2001 | Sterling | B25F 5/00 181/230 |
| 2008/0083582 | A1 * | 4/2008 | Towne | F04B 39/0055 181/230 |
| 2014/0353076 | A1 * | 12/2014 | Bethlenfalvy | F41A 21/30 181/223 |
| 2015/0001001 | A1 * | 1/2015 | Wilson | F41A 21/30 181/223 |

* cited by examiner

*Primary Examiner* — Forrest M Phillips
(74) *Attorney, Agent, or Firm* — Muncy, Geissler, Olds & Lowe, P.C.

(57) ABSTRACT

A silencing mechanism of a pneumatic tool, disposed in an exhaust pipe of the pneumatic tool, includes an annular wall extending along the exhaust pipe, enclosing a first space, and having a plurality of first slits whereby the first space and a second space formed between the annular wall and a pipe wall of the exhaust pipe are in communication with each other; and at least one flange disposed around the annular wall and protruding radially to partition the second space into a plurality of segments, wherein the at least one flange each has a plurality of second slits whereby adjacent segments are in communication with each other. A gas current not only flows freely between the first and second spaces through the first slits but also flows within the second space and passes the second slits, thereby reducing noise.

5 Claims, 6 Drawing Sheets

SILENCING MECHANISM OF PNEUMATIC TOOL

BACKGROUND OF THE INVENTION

1. Technical Field

The present invention relates to pneumatic tools and, more particularly, to a silencing mechanism of a pneumatic tool.

2. Description of Related Art

Pressurized gas is introduced into pneumatic tools to serve as driving power. However, the pneumatic tools produce noise while discharging the pressurized gas to cause the detriment of performance and workers' health. Hence, the pneumatic tools always come with a silencer to reduce the noise.

A common, conventional silencer has therein a silencing cotton made of a nonwoven fabric or cotton. The porous structure of the silencing cotton not only allows passage of a gas current but also generates slight resistance required to slow down the passing gas current, thereby reducing the noise. However, the pneumatic tools are often used in workplaces full of suspended particles, such as dust and chip, as well as impurities, such as water vapor and oil vapor, which are admitted into the pneumatic tools together with the gas current, thereby ending up in the pores of the silencing cotton. The clogged silencing cotton hinders the passage of the gas current, reduces the driving efficiency of the pneumatic tools, and even renders them useless.

BRIEF SUMMARY OF THE INVENTION

It is an objective of the present invention to provide a silencing mechanism of a pneumatic tool, characterized in that an exhaust gas current channel is divided into at least two sub-channels so that a gas current can flow in the sub-channels freely, thereby reducing exhaust-related noise.

Another objective of the present invention is to replace a conventional silencing cotton with the silencing mechanism whereby noise is greatly reduced without undermining the driving efficiency of the pneumatic tool.

In order to achieve the above and other objectives, the present invention provides a silencing mechanism of a pneumatic tool, disposed in an exhaust pipe of the pneumatic tool, the silencing mechanism comprising:

an annular wall extending along the exhaust pipe, enclosing a first space, and having a plurality of first slits whereby the first space and a second space formed between the annular wall and a pipe wall of the exhaust pipe are in communication with each other;

and at least one flange disposed around the annular wall and protruding radially to partition the second space into a plurality of segments, wherein the at least one flange each has a plurality of second slits whereby adjacent segments are in communication with each other.

In an embodiment, the first slits extend in an extension direction of the annular wall.

In an embodiment, the two flanges are disposed on an outer surface of the annular wall and spaced apart to partition the second space into three segments each of which at least one said first slit corresponding in position to is disposed on the annular wall.

In an embodiment, an end wall is disposed at each of two ends of the annular wall.

In an embodiment, the annular wall has a notch corresponding in position to a bump disposed on the pipe wall of the exhaust pipe.

DETAILED DESCRIPTION OF THE INVENTION

Figure 1:
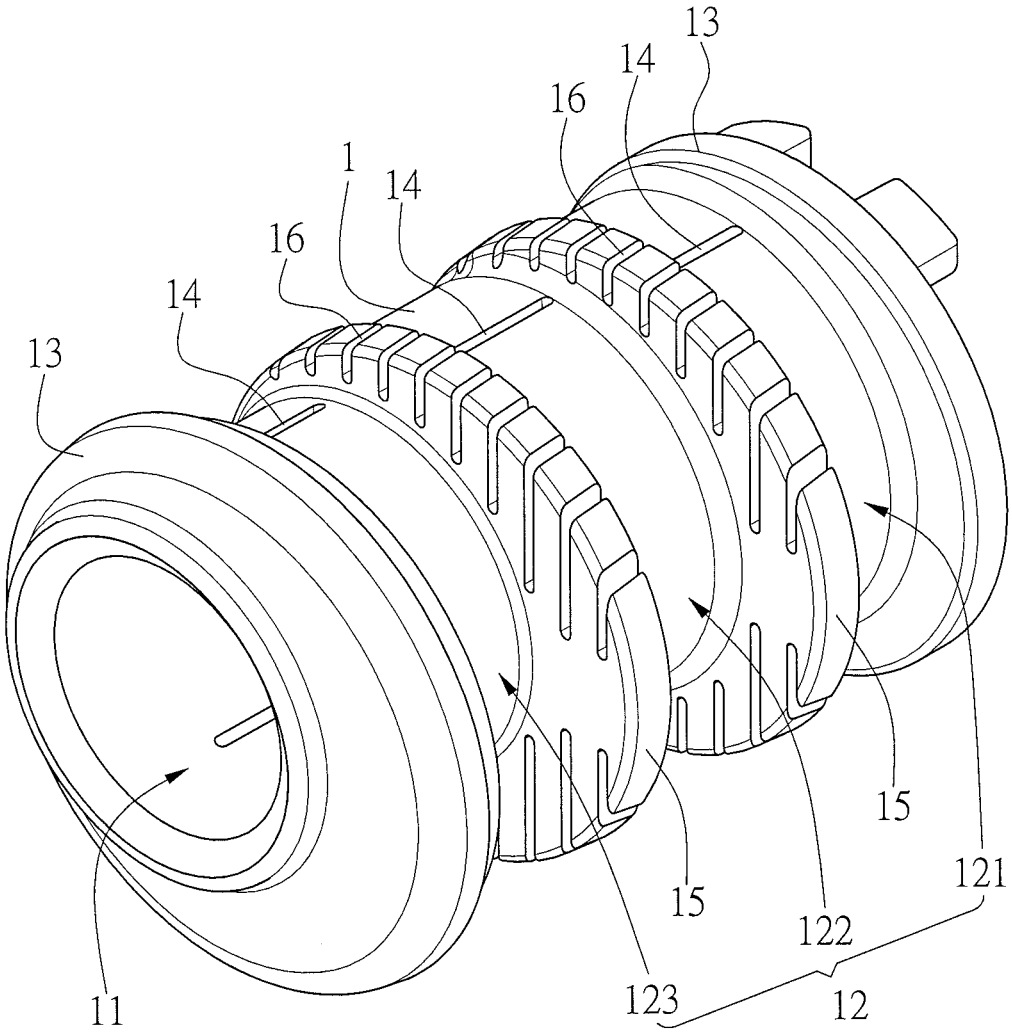
FIG. 1 is a perspective view of a silencing mechanism according to the first embodiment of the present invention.
Figure 2:
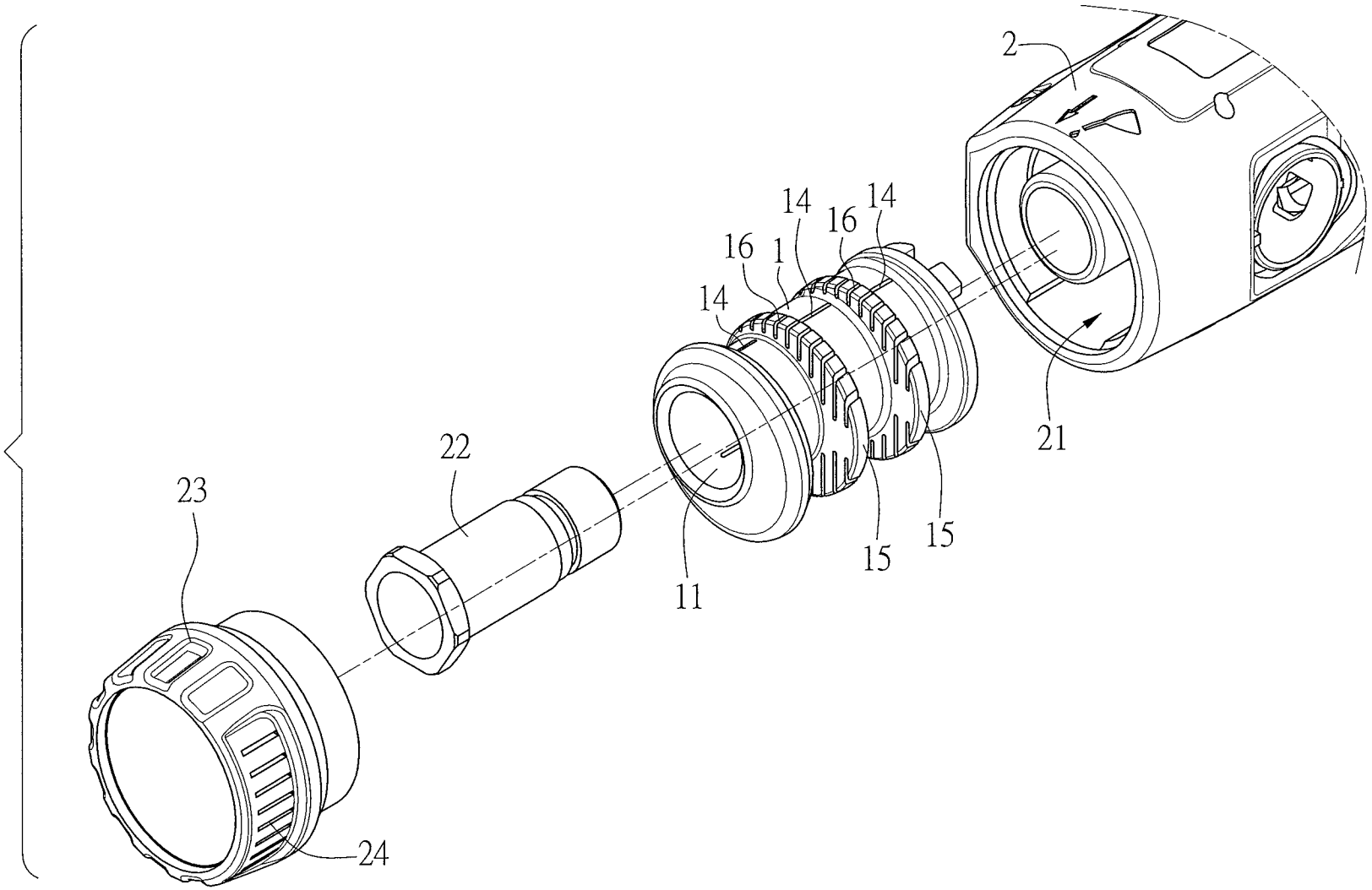
FIG. 2 is a perspective exploded view of the silencing mechanism operating in conjunction with a pneumatic tool according to the first embodiment of the present invention.
Figure 3:
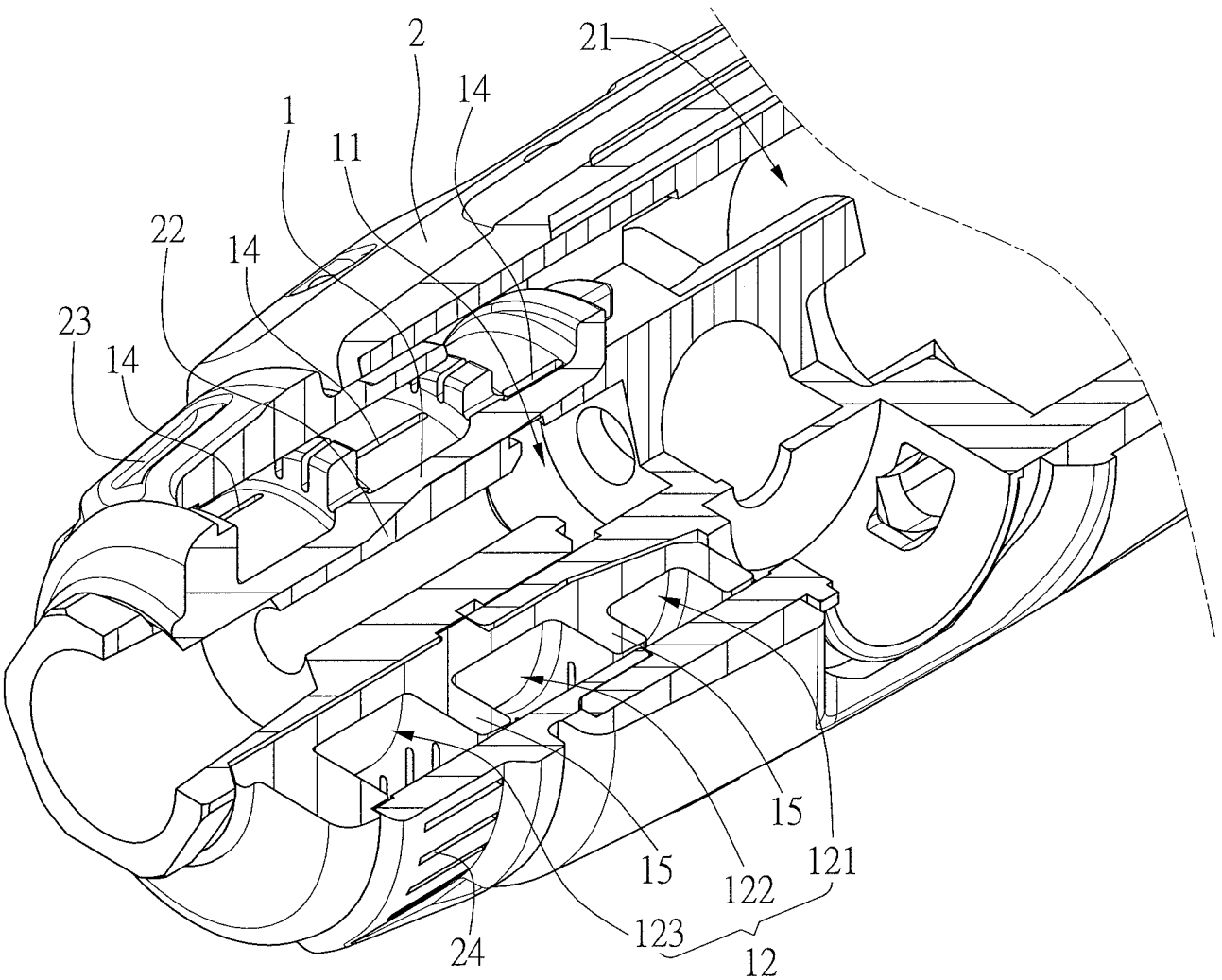
FIG. 3 is a perspective cross-sectional view of the silencing mechanism operating in conjunction with a pneumatic tool according to the first embodiment of the present invention.

Referring to FIG. 1 through FIG. 3, in the first embodiment of the present invention, a silencing mechanism of a pneumatic tool 2 is disposed in an exhaust pipe 21 of the pneumatic tool 2. The silencing mechanism comprises an annular wall 1. The annular wall 1 in the exhaust pipe 21 extends along the exhaust pipe 21 so that two spaces are created by partitioning the exhaust pipe 21, namely a first space 11 and a second space 12. The first space 11 is enclosed by the annular wall 1. The second space 12 is formed between the annular wall 1 and a pipe wall of the exhaust pipe 21. An end wall 13 is disposed at each of the two ends of the annular wall 1.

Disposed on the annular wall 1 is a plurality of first slits 14 whereby the first space 11 and the second space 12 are in communication with each other. In this embodiment, the first slits 14 are each a slender linear opening which extends in the extension direction of the annular wall 1. A plurality of flanges 15 is disposed on the outer surface of the annular wall 1. The flanges 15 each protrude from the annular wall 1 radially. The flanges 15 are spaced apart by a distance required for a gas current to take a specific time period to pass; hence, the quantity of the flanges 15 depends on the length of the annular wall 1. This embodiment is exemplified by two flanges 15 which partition the second space 12 into a first segment 121, a second segment 122 and a third segment 123. Each segment 121, 122, 123 has at least one said first slit 14 whereby each segment 121, 122, 123 is in communication with the first space 11.

The flanges 15 each have a plurality of second slits 16 whereby adjacent segments of the second space 12 are in communication with each other. The second slits 16 are each a slender linear opening.

Referring to FIGS. 2, 3, which show that the silencing mechanism of the present invention is mounted on a conventional pneumatic tool, a feed pipe 22 is penetratingly disposed in the first space 11 of the annular wall 1. The feed pipe 22 does not fully occupy the first space 11, and thus the first space 11 still has a gap for discharging the gas current. An end cover 23 is disposed at the end of the exhaust pipe 21. A vent 24 capable of changing an outgoing direction thereof as a result of rotation is disposed at the end cover 23.

Figure 4:
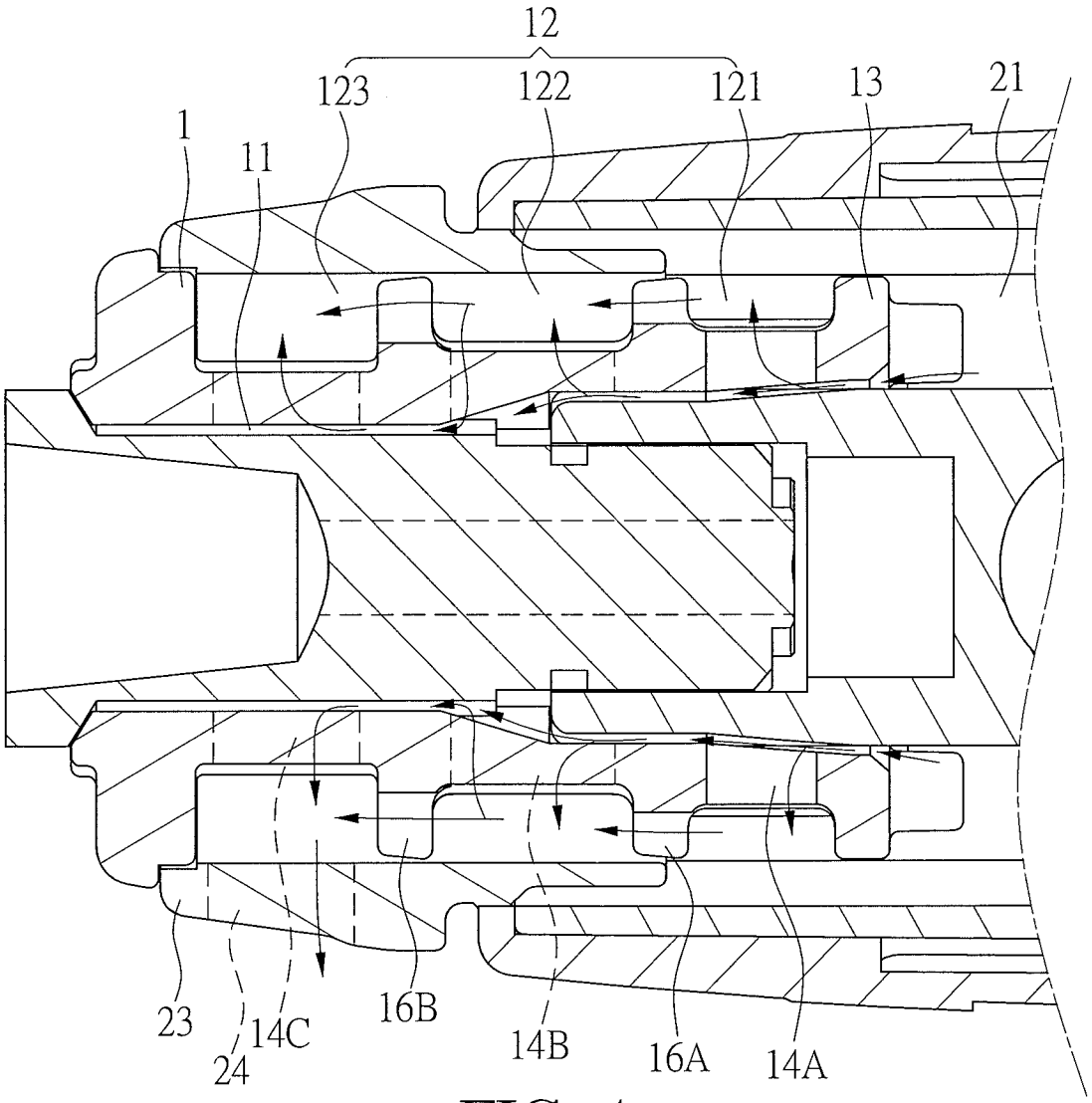
FIG. 4 is a cross-sectional view of the silencing mechanism in operation according to the first embodiment of the present invention.

Referring to FIGS. 3, 4, after being discharged from the exhaust pipe, the gas current is introduced into the first space 11 and the second space 12 (which are separated by the annular wall 1) and then divided into distributaries: a portion of the gas current passes the first space 11, whereas the other portion of the gas current not only passes the first slit 14A to enter the first segment 121 of the second space 12, but also passes the second slit 16A to penetrate the flanges 15 and enter the second segment 122. The portion of the gas current which has entered the second segment 122 is divided into distributaries. The portion of the gas current which has entered the second space 12 passes the second slit 16B and proceeds to the third segment 123 before being discharged from the vent 24. A portion of the gas current passes the first slit 14B to enter the first space 11 and reach the third segment 123, and then it passes the first slit 14C to reach the third segment 123 before being discharged from the vent 24.

The exhaust pipe 21 essentially comprises an inner channel and an outer channel, namely the first space 11 and the second space 12. The gas current flows freely between the inner and outer channels through slender slits and thereby forms a plurality of branches. The branches collide with each other and graze against each other in the course of their flow, thereby reducing the noise produced by the gas current being discharged from the vent 24. Test results show that the silencing mechanism of the present invention is not only capable of silencing, without a conventional silencing cotton, as well as or even better than the conventional silencing cotton, but also effective in discharging the gas current from pneumatic tools and preventing damage otherwise caused to the pneumatic tools (because no silencing cotton is required, and in consequence no impurities and suspended particles of the gas current can clog the channels.)

Figure 5:
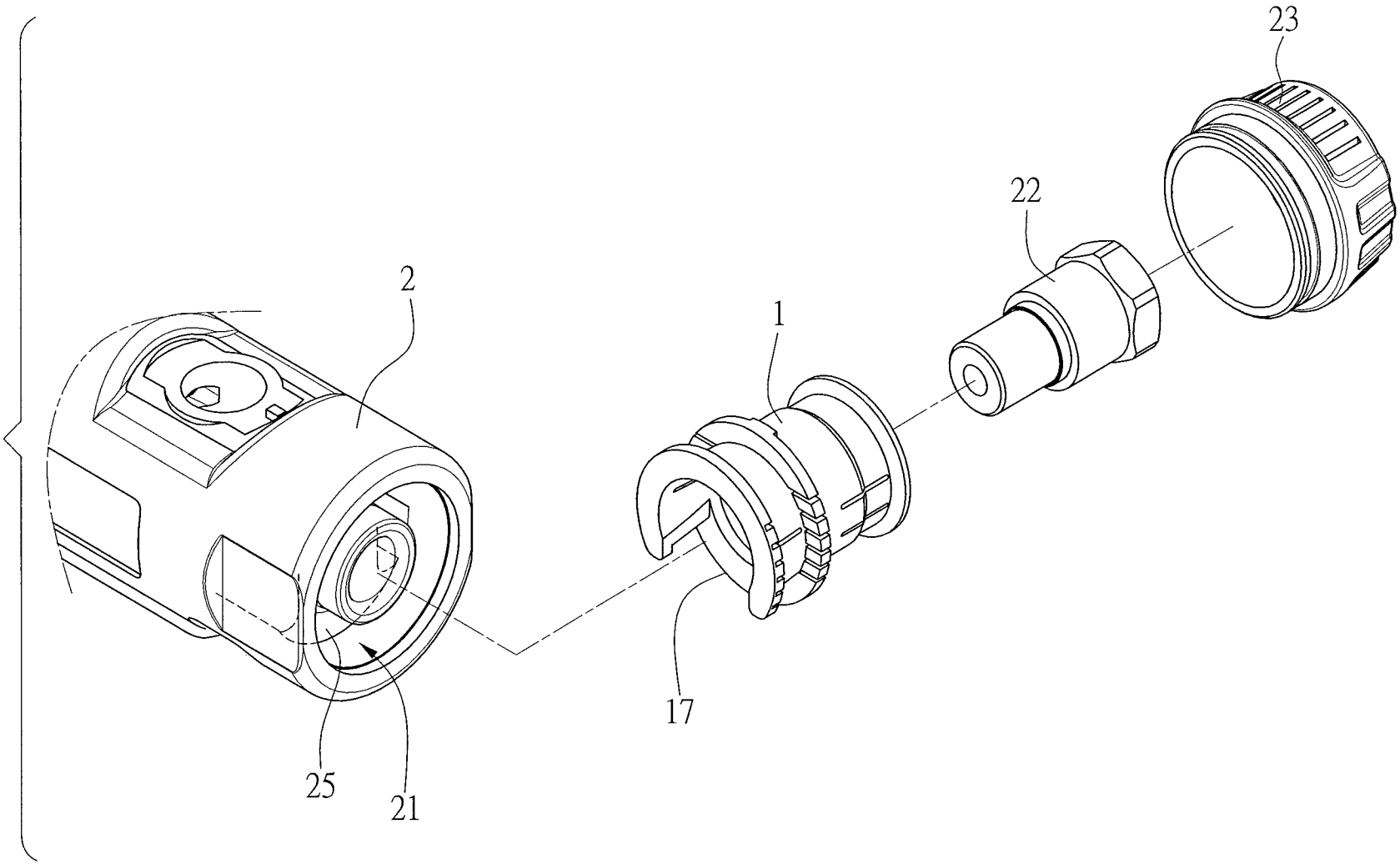
FIG. 5 is a perspective exploded view of the silencing mechanism operating in conjunction with the pneumatic tool according to the second embodiment of the present invention.
Figure 6:
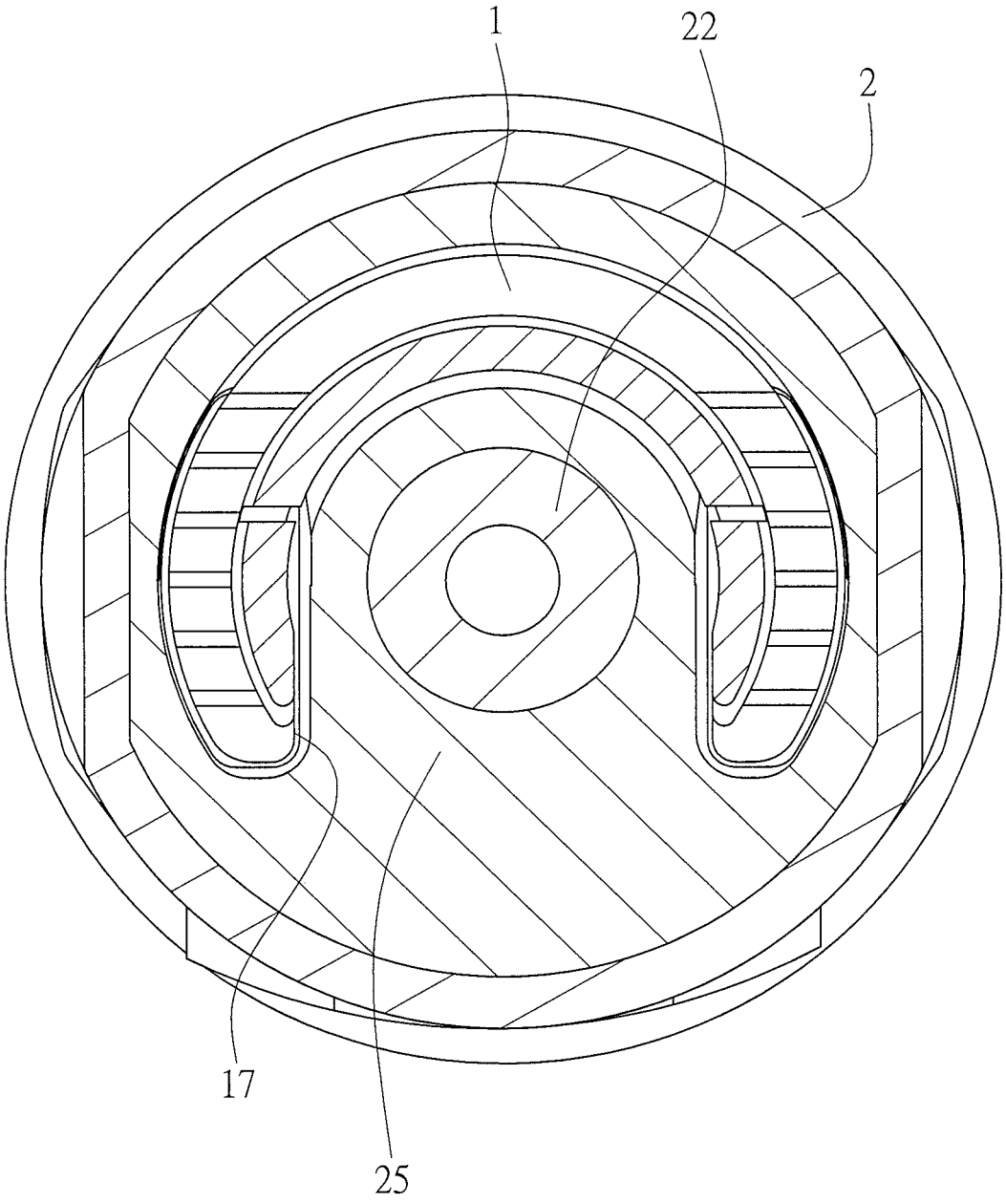
FIG. 6 is a perspective cross-sectional view of the silencing mechanism operating in conjunction with the pneumatic tool according to the second embodiment of the present invention.

FIG. 5 illustrates the second embodiment of the present invention. The second embodiment differs from the first embodiment only in the shape of the annular wall 1. To suit the annular wall 1 of the second embodiment, a bump 25 is disposed on the pipe wall of the exhaust pipe 21 of the pneumatic tool 2. Hence, in the second embodiment, the annular wall 1 has a notch 17 corresponding in position to the bump 25. Referring to FIG. 6, the annular wall 1 is smoothly inserted into the exhaust pipe 21, using the notch 17 to stay away from the bump 25. Therefore, the second embodiment is as effective as the first embodiment in silencing.

What is claimed is:

1. A silencing mechanism of a pneumatic tool, disposed in an exhaust pipe of the pneumatic tool, the silencing mechanism comprising:

an annular wall extending along the exhaust pipe, wherein a first space is enclosed by the annular wall, and a second space is formed between the annular wall and a pipe wall of the exhaust pipe; a plurality of first slits is disposed on the annular wall to communicate the first space and the second space; and at least one flange disposed around the annular wall and protruding radially to partition the second space into a plurality of segments, and adjacent segments are in communication with each other by a plurality of second slits disposed on the at least one flange, wherein at least one of said first slits is distributed corresponding in position to each of said plurality of segments, the plurality of second slits are parallel to each other and extend to a periphery of the flange.

2. The silencing mechanism of a pneumatic tool according to claim 1, wherein the first slits extend in a longitudinal direction of the annular wall.

3. The silencing mechanism of a pneumatic tool according to claim 1, wherein two flanges are disposed on the annular wall and spaced apart to partition the second space into three segments.

4. The silencing mechanism of a pneumatic tool according to claim 1, wherein an end wall is disposed at each of two ends of the annular wall.

5. The silencing mechanism of a pneumatic tool according to claim 1, wherein the annular wall has a notch corresponding in position to a bump disposed on the pipe wall of the exhaust pipe.

* * * * *